US009240136B2

(12) United States Patent
Chang et al.

(10) Patent No.: US 9,240,136 B2
(45) Date of Patent: Jan. 19, 2016

(54) DRIVING CIRCUIT FOR DISPLAY DEVICE

(75) Inventors: Kuk-Hui Chang, Paju-si (KR); Young-Nam Lee, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 1110 days.

(21) Appl. No.: 12/890,568

(22) Filed: Sep. 24, 2010

(65) Prior Publication Data

US 2011/0074760 A1 Mar. 31, 2011

(30) Foreign Application Priority Data

Sep. 25, 2009 (KR) ..... 10-2009-0091234

(51) Int. Cl.
*G09G 3/20* (2006.01)

(52) U.S. Cl.
CPC ..... *G09G 3/2088* (2013.01); *G09G 3/20* (2013.01); *G09G 3/2092* (2013.01); *G09G 2310/0232* (2013.01); *G09G 2330/02* (2013.01); *G09G 2330/024* (2013.01)

(58) Field of Classification Search
CPC ..... G09G 3/2088; G09G 3/20; G09G 2310/0232; G09G 3/2092; G09G 2330/024; G09G 2330/02; G06F 3/038
USPC ..... 345/212
See application file for complete search history.

(56) References Cited

U.S. PATENT DOCUMENTS 5,489,867 A 2/1996 Tamanoi
6,456,271 B1 9/2002 Tamai et al.
6,525,718 B1 * 2/2003 Murakami ..... G02F 1/13452 345/103
6,686,987 B1 2/2004 Sakaki et al.
7,561,124 B2 * 7/2009 Kwak ..... G09G 3/3233 315/169.1
7,576,713 B2 * 8/2009 Han et al. ..... 345/60
7,705,820 B2 * 4/2010 Park ..... G09G 3/3677 330/207 A
7,710,382 B2 * 5/2010 Park ..... G09G 3/3648 324/537
8,456,455 B2 * 6/2013 Kojima ..... G09G 3/3291 345/204
2001/0015709 A1 8/2001 Imajo et al.
2005/0057483 A1 * 3/2005 Sekido ..... G09G 3/3611 345/100
2005/0116919 A1 * 6/2005 Shin ..... G09G 3/325 345/100
2005/0206605 A1 * 9/2005 Park et al. ..... 345/98
2006/0022603 A1 2/2006 Shiraishi
2007/0229436 A1 10/2007 Sun
2007/0247397 A1 * 10/2007 Han et al. ..... 345/67

(Continued)

FOREIGN PATENT DOCUMENTS

JP 7-13509 A 1/1995
JP 9-171376 A 6/1997

(Continued)

*Primary Examiner* — Temesgh Ghebretinsae
*Assistant Examiner* — Michael J Jansen, II
(74) *Attorney, Agent, or Firm* — Birch, Stewart, Kolasch & Birch, LLP

(57) ABSTRACT

A data driving circuit for a display panel. The data driving circuit includes a driving integrated circuit including a plurality of data driving units configured to supply image data to data lines of the display panel; and a package body including: a mount region in which the driving integrated circuit is mounted, logic power input patterns configured to transmit logic power to the plurality of data driving units, and at least two external auxiliary transmission lines formed in the mount region and connected to at least one logic power input pattern. Further, the at least two external auxiliary transmission lines are configured to transmit power received from the at least one connected logic power input pattern to data driving units located farthest from said at least one logic power input pattern.

20 Claims, 8 Drawing Sheets

(56) References Cited

U.S. PATENT DOCUMENTS

| | | | | |
|---|---|---|---|---|
| 2008/0117235 | A1 | 5/2008 | Morita | |
| 2008/0239184 | A1* | 10/2008 | Kim et al. | 349/41 |
| 2010/0052558 | A1* | 3/2010 | Lee et al. | 315/250 |
| 2010/0194731 | A1 | 8/2010 | Hiratsuka | |
| 2010/0220080 | A1* | 9/2010 | Kojima | G09G 3/3291 345/204 |
| 2010/0245299 | A1* | 9/2010 | Han | G02F 1/13452 345/204 |
| 2011/0074745 | A1* | 3/2011 | Chang | G09G 3/20 345/204 |
| 2011/0074746 | A1* | 3/2011 | Chang | G09G 3/20 345/204 |

FOREIGN PATENT DOCUMENTS

| | | | |
|---|---|---|---|
| JP | 2000-242240 | A | 9/2000 |
| JP | 2000-352723 | A | 12/2000 |
| JP | 2001-56481 | A | 2/2001 |
| JP | 2001-306040 | A | 11/2001 |
| JP | 2003-233358 | A | 8/2003 |
| JP | 2004-205901 | A | 7/2004 |
| JP | 2006-47425 | A | 2/2006 |
| JP | 2007-272180 | A | 10/2007 |
| JP | 2008-14996 | A | 1/2008 |
| JP | 2008-129029 | A | 6/2008 |
| JP | 2010-176083 | A | 8/2010 |

* cited by examiner

DRIVING CIRCUIT FOR DISPLAY DEVICE

This application claims the benefit of Korean Patent Application No 10-2009-0091234, filed on Sep. 25, 2009, which is hereby incorporated by reference as if fully set forth herein.

BACKGROUND OF THE INVENTION

1. Field of the Invention

An embodiment of the present invention relates to a driving circuit for a display device that prevents a block dim phenomenon and a noise phenomenon from occurring at edges of a screen by supplying power to data driving units located at edges of a driving integrated circuit.

2. Discussion of the Related Art

A driving integrated circuit includes a plurality of data driving units for supplying image data to data lines of a panel. The data driving units are driven by supplying logic power to the data driving units. However, the data driving units are not always driven in an appropriate manner, which results in uneven or distorted images.

SUMMARY OF THE INVENTION

Accordingly, one object of the present invention is to provide a driving circuit for a display device that substantially obviates one or more problems due to limitations and disadvantages of the related art.

Another object of the present invention is to provide a driving circuit for a display device that reduces a distortion of logic power supplied to data driving units located on both edges of a driving integrated circuit by supplying logic power transmitted through external auxiliary transmission lines, auxiliary input pins and internal auxiliary transmission lines to the two data driving units located on both edges of the driving integrated circuit.

To achieve these objects and other advantages and in accordance with the purpose of the invention, as embodied and broadly described herein, the present invention provides in one aspect a data driving circuit for a display panel. The data driving circuit includes a driving integrated circuit including a plurality of data driving units configured to supply image data to data lines of the display panel; and a package body including: a mount region in which the driving integrated circuit is mounted, logic power input patterns configured to transmit logic power to the plurality of data driving units, and at least two external auxiliary transmission lines formed in the mount region and connected to at least one logic power input pattern. Further, at least two external auxiliary transmission lines are configured to transmit power received from the at least one connected logic power input pattern to data driving units located farthest from said at least one logic power input pattern.

In another aspect, the present invention provides a display device including a display panel including a plurality of data and gate lines interesting each other; and a data driving circuit for driving the display panel and including a driving integrated circuit including a plurality of data driving units configured to supply image data to data lines of the display panel; and a package body. Further, the package body includes a mount region in which the driving integrated circuit is mounted, logic power input patterns configured to transmit logic power to the plurality of data driving units, and at least two external auxiliary transmission lines formed in the mount region and connected to at least one logic power input pattern. Further, the at least two external auxiliary transmission lines are configured to transmit power received from the at least one connected logic power input pattern to data driving units located farthest from said at least one logic power input pattern.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings.

Figure 1:
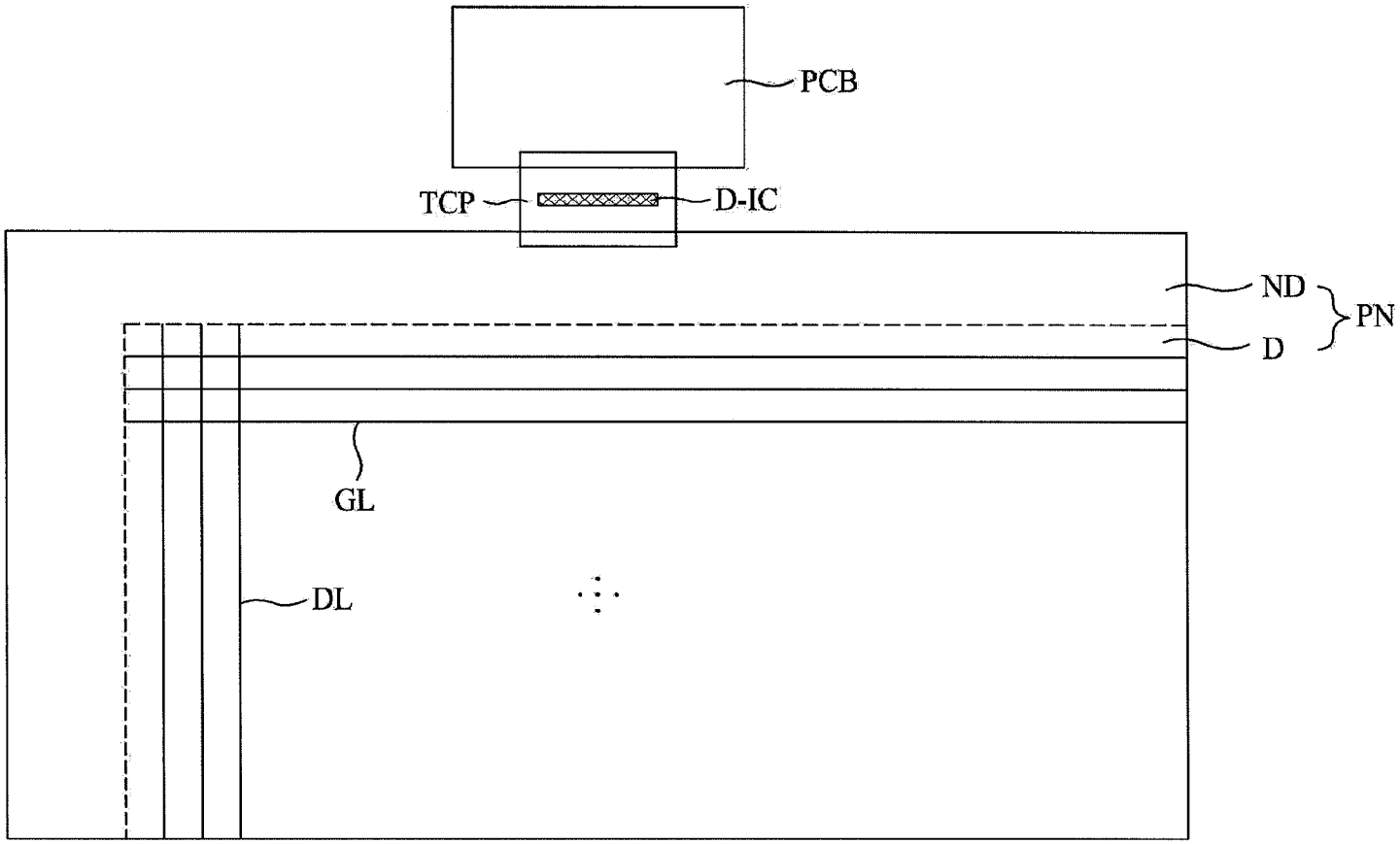
FIG. 1 is a diagram showing a display device including a driving circuit according to an embodiment of the present invention.

FIG. 1 is a diagram showing a display device including a driving circuit (DRC) according to an embodiment of the present invention. As shown, the display device includes a panel PN having a display unit D for displaying an image and a non-display unit ND surrounding the display unit D. The panel PN may be a panel including liquid crystal, a panel including an organic light-emitting diode, etc. Also included is the driving circuit DRC having a driving integrated circuit D-IC for generating various signals used to display the image on the display unit D of the panel PN and a surface mount type package TCP in which the driving integrated circuit D-IC is mounted. Further, a tape carrier package may be used as the surface mount type package TCP.

In addition, as shown in FIG. 1, one side of the driving circuit DRC is connected to a Printed Circuit Board (PCB) and the other side of the driving circuit DRC is connected to the non-display unit ND of the panel PN. The PCB is also connected to an external system that supplies image data and various control signals to the driving circuit DRC through the PCB. Further, the display unit D of the panel PN includes a plurality of gate lines GL and data lines DL, which intersect each other, and pixels for displaying the image according to gate signals from the gate lines GL and image data from the data lines DL.

Also, the non-display unit ND of the panel PN includes a plurality of data link lines for transmitting the image data from the driving circuit DRC to the data lines DL and a plurality of data link lines for transmitting the gate signals from the driving circuit DRC to the gate lines GL. The driving circuit DRC of FIG. 1 will now be described in more detail with respect to FIGS. 2 and 3.

Figure 2:
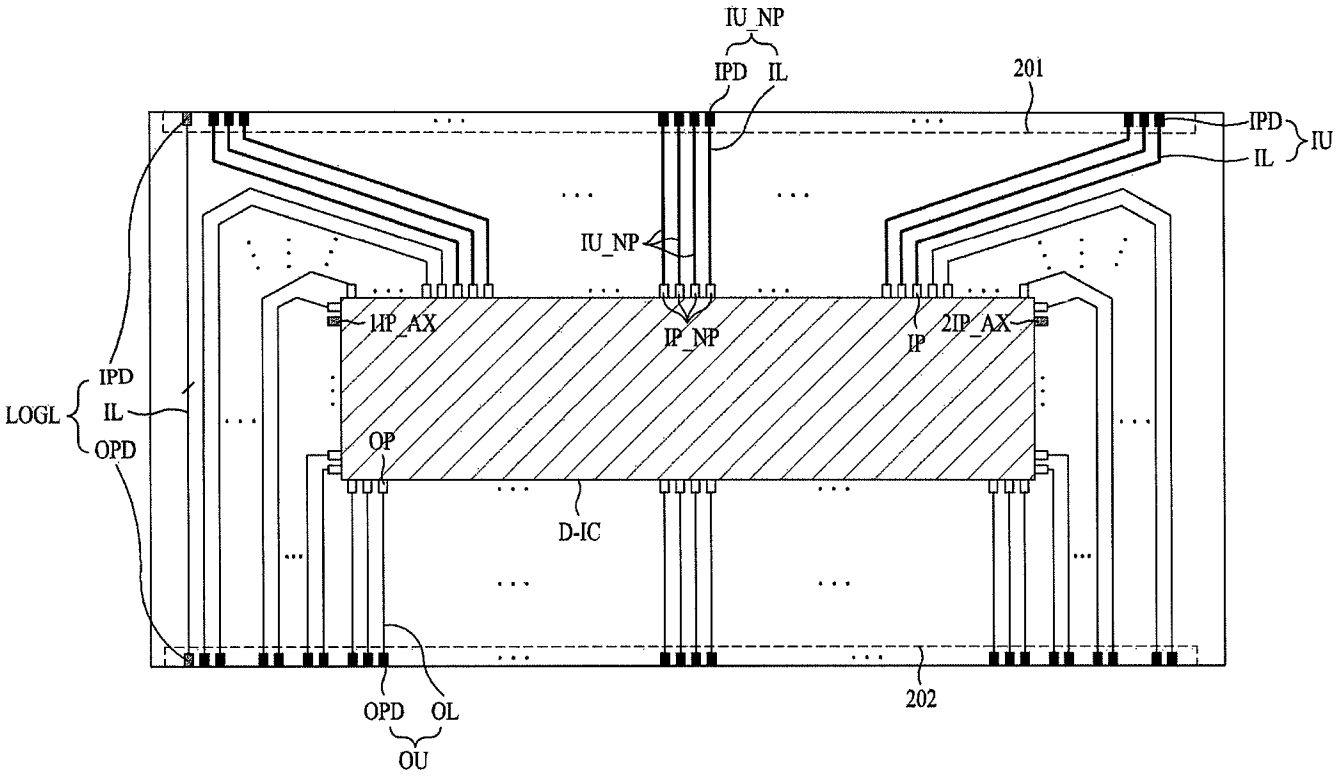
FIG. 2 is a diagram showing a driving integrated circuit of FIG. 1 according to an embodiment of the present invention.
Figure 3:
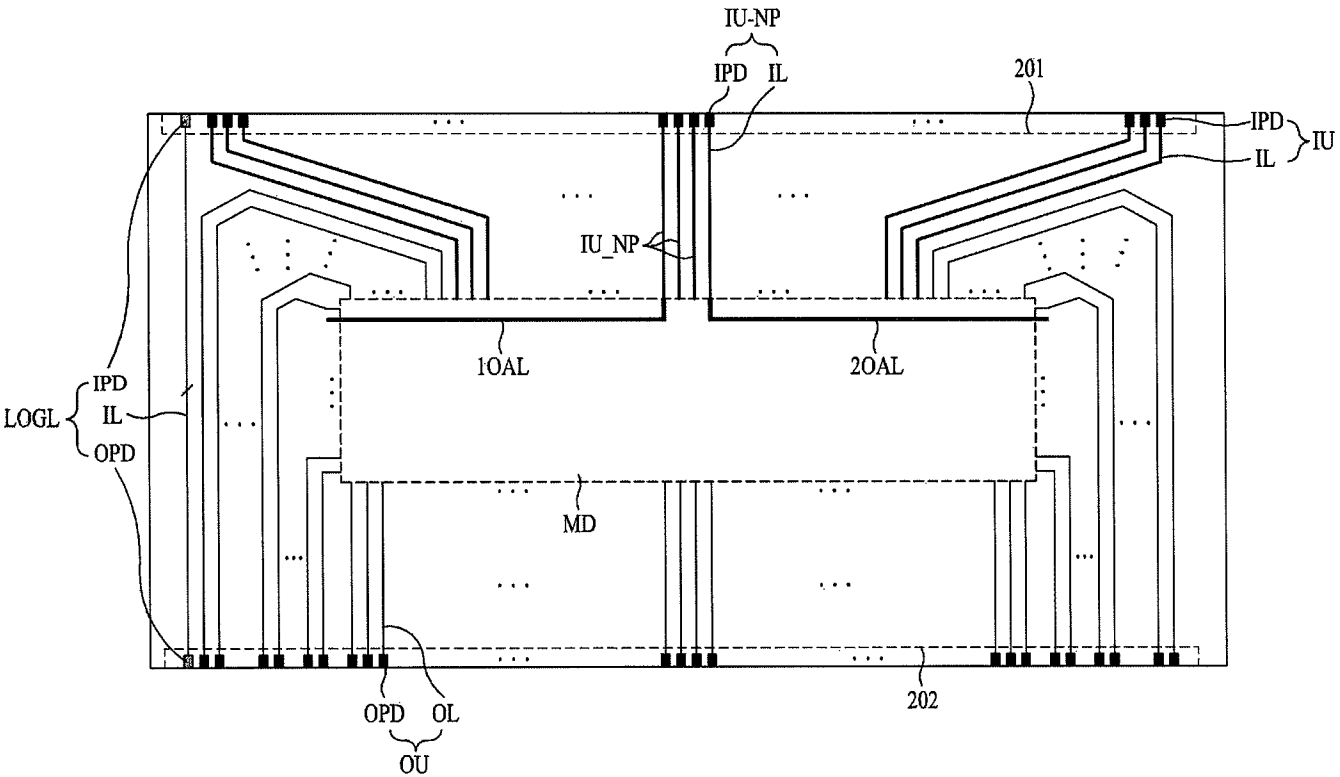
FIG. 3 is a diagram showing a surface mount type package according to a first embodiment of the present invention.

In particular, FIG. 2 is a diagram showing the driving integrated circuit of FIG. 1, and FIG. 3 is a diagram showing a surface mount type package TCP according to a first embodiment of the present invention. In addition, FIG. 3 shows only the surface mount type package TCP in the driving circuit DRC of FIG. 1.

As shown in FIGS. 2 and 3, the surface mount type package TCP includes a mount region MD in which the driving integrated circuit D-IC is mounted, a plurality of input patterns IU for connecting input pins IP of the driving integrated circuit D-IC to the external system, and a plurality of output patterns OU for connecting output pins OP of the driving integrated circuit D-IC to the panel PN. In order to distinguish between the input patterns IU and the output patterns OU in FIGS. 2 and 3, the thickness of input lines IL included in the input patterns IU is greater than that of output lines OL included in the output patterns OU. That is, for convenience, the thicknesses of the input lines and the output lines are differently shown in the drawing. However, the actual thicknesses of the input lines IL and the output lines OL may be set to be equal to each other.

In addition, the input patterns IU connect the input pins IP of the driving integrated circuit D-IC to the external system, and each input pattern IU includes input pads IPD formed in an input pad portion 201 located on one end of the surface mount type package TCP and the input lines IL for connecting the input pads IPD and the input pins IP. Further, one or more of the plurality of input patterns IU are used for transmitting logic power from the external system and thus are called logic power input patterns IU_NP so as to be distinguished from the other input patterns IU. Also, as shown in FIGS. 2 and 3, each logic power input pattern IU_NP also includes input pads IPD and input lines IL.

Further, the output patterns OU connect the output pins OP of the driving integrated circuit D-IC to the panel PN, that is, the data lines DL of the panel PN. Each output pattern OU also includes output pads OPD formed in an output pad portion 202 located on the other end of the surface mount type package TCP and the output lines OL for connecting the output pads OPD and the output pins OP.

In one example, a plurality of Line On Glass (LOG) type transmission patterns LOGL are formed at a left edge of the surface mount type package TCP. As shown, the LOG type transmission patterns LOGL are directly connected to LOG type signal transmission lines formed in the non-display unit ND of the panel PN without passing through the driving integrated circuit D-IC. The LOG type transmission patterns LOGL also serve to supply a driving voltage, a ground voltage and the like supplied from the external system to the panel PN through the PCB. In addition, each LOG type transmission pattern LOGL includes an input pad IPD formed in the input pad portion 201, an output pad OPD formed in the output pad portion 202, and a transmission line IL for connecting the input pad IPD and the output pad OPD.

Also, in one embodiment, the driving integrated circuit D-IC is mounted in a Chip On film (COF) manner in the mount region MD of the surface mount type package TCP. As shown in FIG. 3, the mount region MD is an empty region in which no electrical line is formed before the driving integrated circuit D-IC is mounted. Further, according to an embodiment of the present invention, external auxiliary transmission lines 10AL and 20AL are formed in the empty region before mounting the driving integrated circuit D-IC in the mount region MD. A plurality of external auxiliary transmission lines 10AL and 20AL may also be formed. For example, two external auxiliary transmission lines 10AL and 20AL are shown in FIG. 3 as one embodiment of the present invention.

As shown in FIG. 3, one side of each of the external auxiliary transmission lines 10AL and 20AL is connected to the input line IL of the logic power input pattern IU_NP. When a plurality of external auxiliary transmission lines 10AL and 20AL are formed as shown in FIG. 3, the external auxiliary transmission lines 10AL and 20AL may be separately connected to the logic power input patterns IU_NP. Alternatively, one side of each of the external auxiliary transmission lines 10AL and 20AL may be connected to one logic power input pattern IU_NP together.

Figure 4:
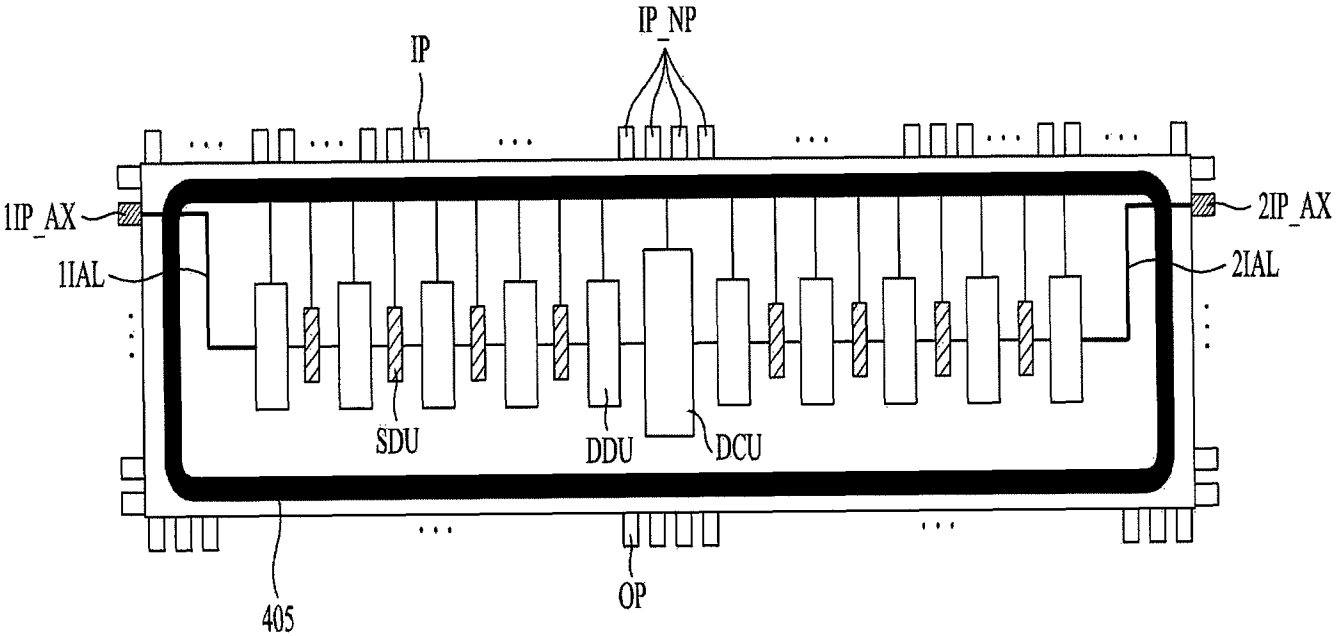
FIG. 4 is a diagram showing a driving integrated circuit according to the first embodiment of the present invention.

Next, FIG. 4 is a diagram showing a driving integrated circuit D-IC according to the first embodiment of the present invention. FIG. 4 also shows only the driving integrated circuit D-IC in the driving circuit DRC of FIG. 1. As shown in FIG. 4, the driving integrated circuit D-IC includes a plurality of input pins IP, a plurality of output pins OP, one or more auxiliary input pins 1IP_AX and 2IP_AX, one or more internal auxiliary transmission lines 1IAL and 2IAL, a logic power transmission line 405, a driving control unit DCU, a plurality of driving units DDU, and a plurality of signal delay/buffer units SDU.

One or more of the plurality of input pins IP are also connected to the input line IL of the logic power input patterns IU_NP. Further, the input pins IP connected to the logic power input patterns IU_NP are called logic power input pins IP_NP so as to be distinguished from the other input pins IP. In addition, the plurality of input pins IP, the plurality of output pins OP and one or more auxiliary input pins 1IP_AX are formed on the outer edges of the driving integrated circuit D-IC and serve to electrically connect the various circuits formed inside the driving integrated circuit D-IC to the external input patterns IU and output patterns OU.

Also, one or more internal auxiliary transmission lines, the logic power transmission line 405, the plurality of data driving units DDU and the plurality of signal delay/buffer units SDU are formed inside the driving integrated circuit D-IC. In addition, the logic power transmission line 405 is connected to the logic power input pins IP_NP. When a plurality of logic power input pins IP_NP are formed, all of the plurality of logic power input pins IP_NP are commonly connected to the logic power transmission line 405. In more detail, as shown in the example of In FIG. 4, four logic power input pins IP_NP are formed and all four logic power input pins IP_NP are commonly connected to the logic power transmission line 405.

In addition, the plurality of data driving units DDU are formed inside the driving integrated circuit D-IC. Also, the plurality of the data driving units DDU are connected to the logic power transmission line 405 in parallel, and are operated by the logic power from the logic power transmission line 405. Further, the internal auxiliary transmission line HAL is formed inside the driving integrated circuit D-IC, and one side of the internal auxiliary transmission line 1IAL is connected to one or more data driving units DDU.

In addition, a plurality of internal auxiliary transmission lines HAL and 2IAL may be included as shown in FIG. 4, and each of the internal auxiliary transmission lines HAL and 2IAL is independently connected to each of the auxiliary input pins 1IP_AX and 2IP_AX. Alternatively, all the internal auxiliary transmission lines 1IAL and 2IAL may be commonly connected to one auxiliary input pin IP_AX. Further, the auxiliary input pins IP_AX connect the other side of the internal auxiliary transmission lines HAL and 2IAL and the other side of the external auxiliary transmission lines 10AL and 20AL.

With such a structure, the logic power from the external system is supplied to the data driving units DDU and the signal delay/buffer units SDU through the logic power input patterns IU_NP, the logic power input pins IP_NP and the logic power transmission line 405. In particular, one or more data driving units DDU also receive logic power through the following path in addition to the above-described path. That is, one or more data driving units DDU also receive the logic power supplied through the external auxiliary transmission lines 1IAL and 2IAL, the auxiliary input pins IP_AX and the internal auxiliary transmission lines 1IAL and 2IAL. This feature will now be described in more detail.

As shown in FIG. 4, the driving control unit DCU, the plurality of data driving units DDU and the plurality of signal delay/buffer units SDU are connected to the logic power transmission line 405. At this time, n (n is an even number greater than or equal to 6) data driving units DDU are divided into two halves such that n/2 data driving units DDU are arranged on each side of the driving control unit DCU. For example, as shown in FIG. 4, if one driving control unit DCU and ten data driving units DDU are included, five data driving units DDU are arranged in a line on the left side of the driving control unit DCU and the remaining five data driving units DDU are arranged in a line on the right side of the driving control unit DCU.

In addition, the driving control unit DCU is located nearest to the logic power input pins IP_NP and the data driving units DDU are sequentially arranged away from the logic power input pins IP_NP. Thus, weaker logic power is supplied to a data driving unit DDU farthest from the logic power input pins IP_NP, that is, a data driving unit DDU farthest from the driving control unit DCU, as compared with the other data driving units DDUs. Accordingly, logic power transmitted through the external auxiliary transmission lines 10AL and 20AL, the auxiliary input pins 1IP_AX and 2IP_AX and the internal auxiliary transmission lines 1IAL and 2IAL is additionally supplied to two data driving units DDU located on both edges of the driving integrated circuit D-IC so as to reduce distortion of the logic power supplied to the data driving units DDU located on both edges of the driving integrated circuit.

For example, as shown in FIG. 4, the data driving unit DDU, which is farthest from the driving control unit DCU, among the data driving units DDU located on the left side of the driving control unit DCU additionally receives the logic power transmitted through the first external auxiliary transmission line 10AL, the first auxiliary input pin 1IP_AX and the first internal auxiliary transmission line 1IAL. In addition, the data driving unit DDU, which is farthest from the driving control unit DCU, among the data driving units DDU located on the right side of the driving control unit DCU additionally receives the logic power transmitted through the second external auxiliary transmission line 20AL, the second auxiliary input pin 2IP_AX and the second internal auxiliary transmission line 2IAL.

Figure 5:
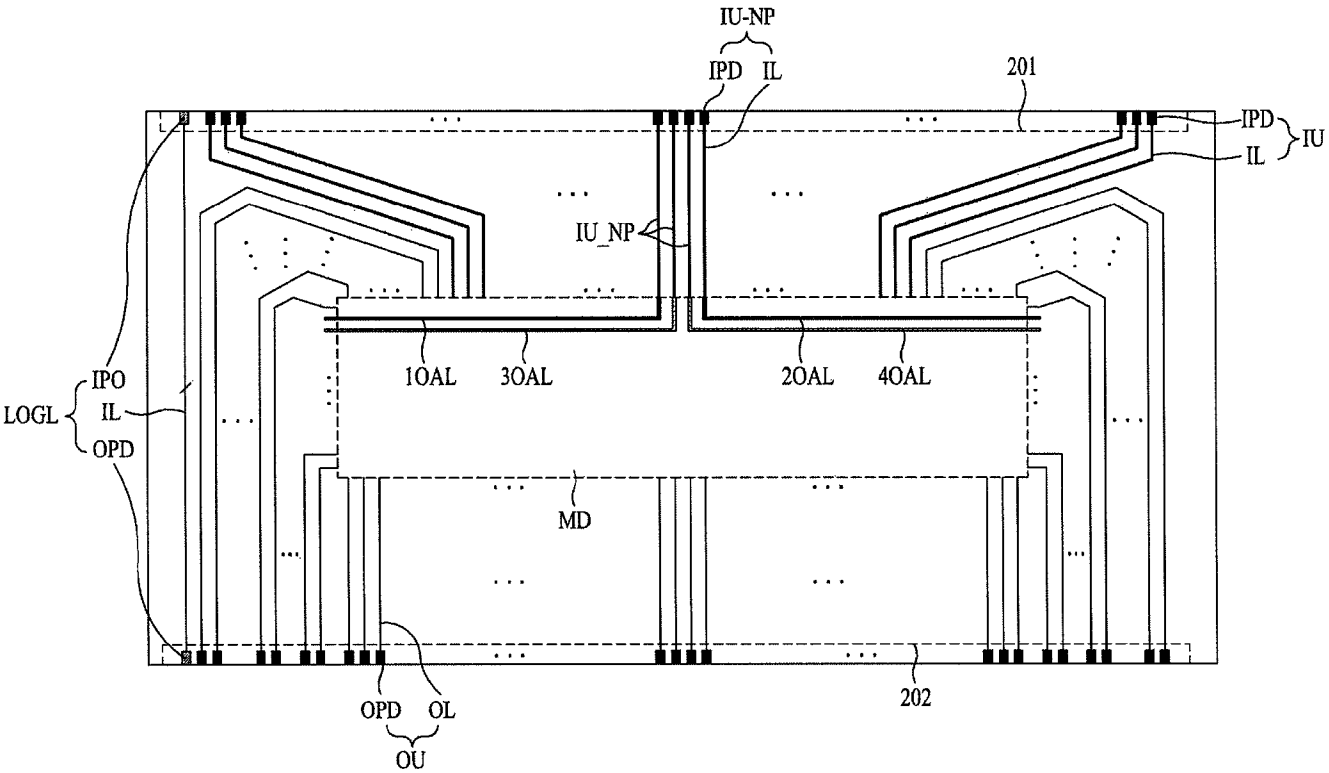
FIG. 5 is a diagram showing a surface mount type package according to a second embodiment of the present invention.
Figure 6:
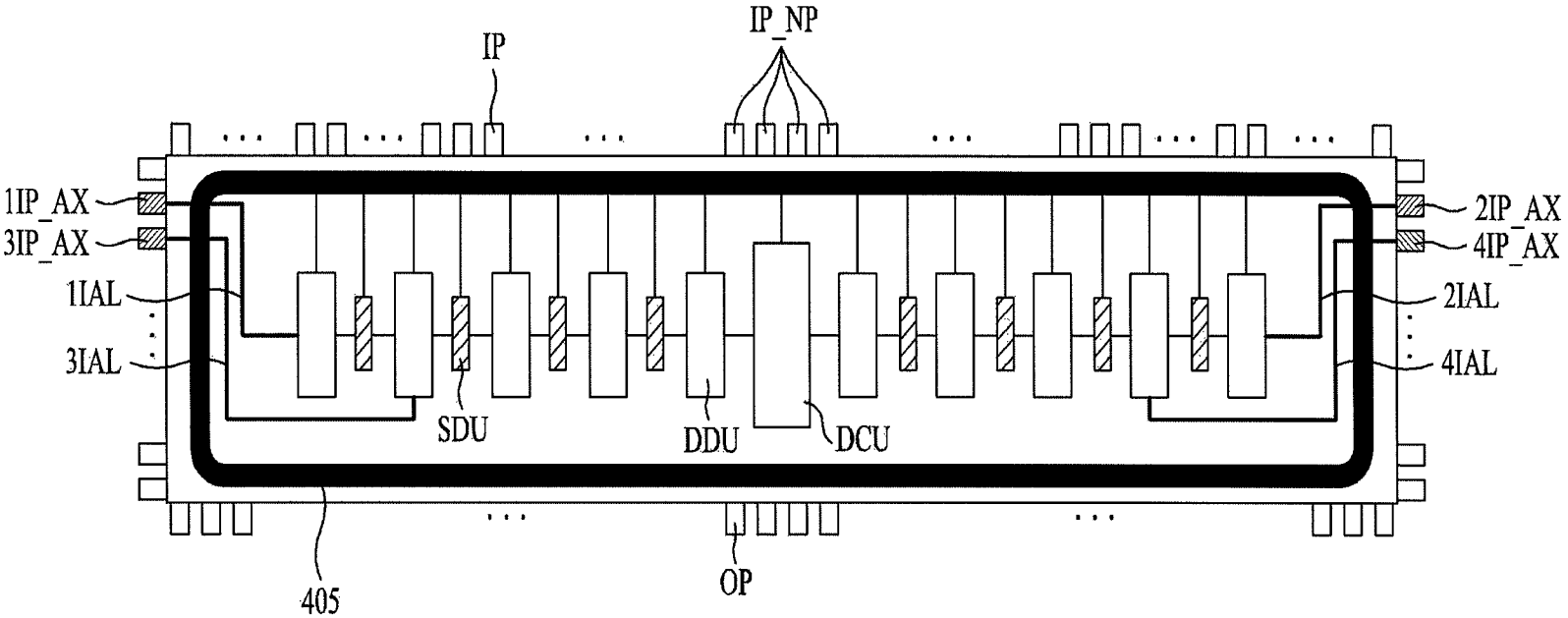
FIG. 6 is a diagram showing a driving integrated circuit according to the second embodiment of the present invention.

Next, FIG. 5 is a diagram showing a surface mount type package TCP according to a second embodiment of the present invention, and FIG. 6 is a diagram showing a driving integrated circuit D-IC according to the second embodiment of the present invention. Further, FIG. 5 is a diagram showing only the surface mount type package TCP in the driving circuit DRC of FIG. 1, and FIG. 6 is a diagram showing only the driving integrated circuit D-IC in the driving circuit DRC of FIG. 1.

Also, in order to distinguish between the input patterns IU and the output patterns OU of FIG. 5, the thickness of the input lines IL included in the input patterns IU is greater than that of the output lines OL included in the output patterns OU. That is, for convenience, the thicknesses of the input lines and the output lines are differently shown in the drawing. However, the actual thicknesses of the input lines IL and the output lines OL may be set to be equal to each other.

In addition, the structure shown in FIG. 5 is obtained by adding two external auxiliary transmission lines 30AL and 40AL to the structure of FIG. 3. As shown in FIG. 5, the first to fourth external auxiliary transmission lines 10AL to 40AL are formed in the mount region MD. Further, the structure shown in FIG. 6 is obtained by adding two auxiliary input pins 3IP_AX and 4IP_AX to the structure of FIG. 4.

As shown in FIG. 6, the first to fourth auxiliary input pins 1IP_AX to 4IP_AX are formed outside the driving integrated circuit D-IC. In addition, the connection relationship between the first and second external auxiliary transmission lines 10AL and 20AL and the first and second auxiliary input pins 1IP_AX and 2IP_AX are described in FIGS. 3 and 4.

As shown in FIG. 6, the data driving unit DDU, which is second farthest from the driving control unit DCU, among the data driving units DDU located on the left side of the driving control unit DCU additionally receives logic power transmitted through the third external auxiliary transmission line 30AL, the third auxiliary input pint 3IP_AX and the third internal auxiliary transmission line 3IAL. In addition, the data driving unit DDU, which is second farthest from the driving control unit DCU, among the data driving units DDU located on the right side of the driving control unit DCU additionally receives logic power transmitted through the fourth external auxiliary transmission line 40AL, the fourth auxiliary input pint 4IP_AX and the fourth internal auxiliary transmission line 4IAL.

Next, the configuration of the driving control unit DCU, the data driving units DDU and the signal delay/buffer units SDU will be described in more detail with respect to FIG. 7, which is a diagram showing the configuration of the driving control unit DCU, the data driving units DDU and the signal delay/buffer units SDU in detail.

Figure 7:
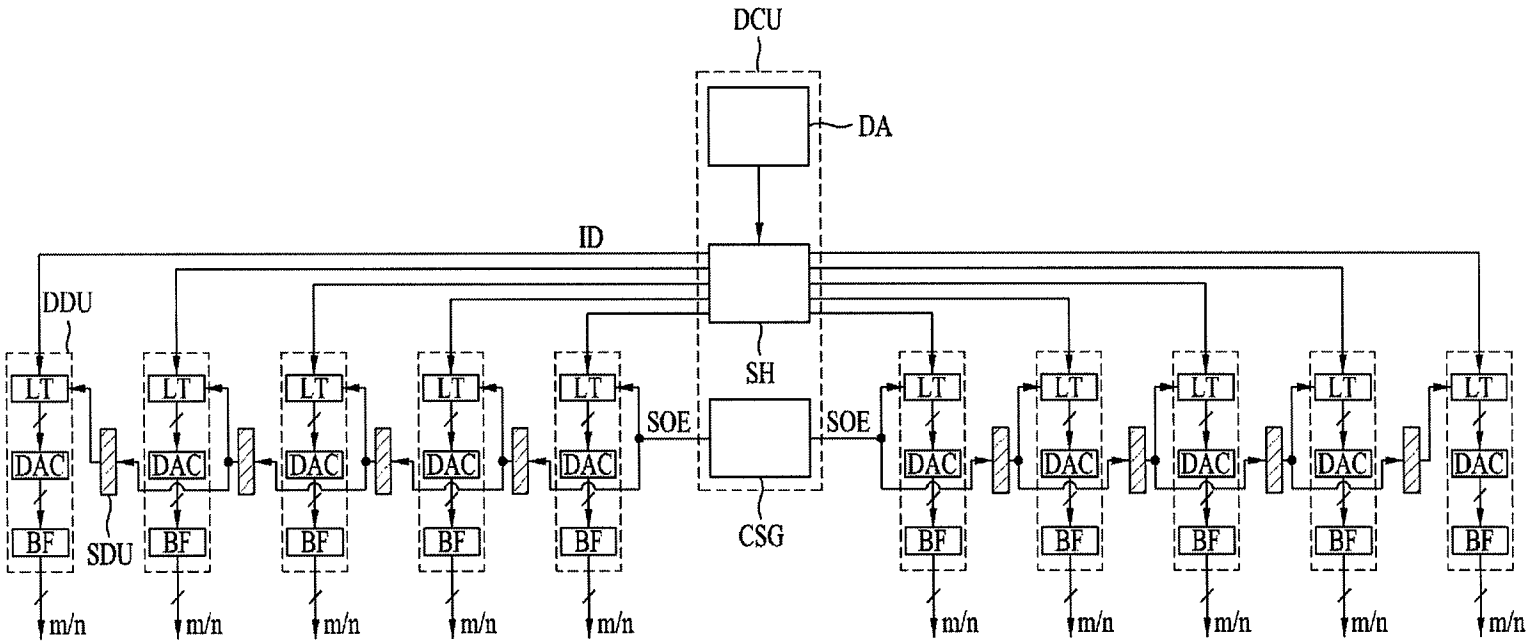
FIG. 7 is a diagram showing the configuration of a driving control unit, data driving units and signal delay/buffer units according to an embodiment of the present invention.

As shown in FIG. 7, the driving control unit DCU includes a data alignment unit DA, a sample/hold unit SH and a control signal generation unit (CSG). The data alignment unit DA realigns image data ID from the external system and outputs the realigned image data. Further, the sample/hold unit SH sequentially samples and holds the image data ID from the data alignment unit DA. Also, the control signal generation unit CSG receives a control signal from the external system and outputs various timing control signals including a source output enable signal SOE.

In addition, each data driving unit DDU includes a latch LT, a digital/analog converter DAC, and a signal buffer BF. In more detail, the latch LT simultaneously receives m/n pieces of sampled image data ID among m (m=k*n; k is a natural number greater than or equal to 4) pieces of sampled image data from the sample/holding unit SH and simultaneously outputs m/n pieces of sampled image data ID in response to the source output enable signal SOE. That is, n pieces of sampled image data ID stored in the sample/hold unit SH are equally divided and supplied to the latch LT of each of the data driving units DDUs, and the latch LT simultaneously outputs the sampled image data ID in response to the source output enable signal SOE from the control signal generation unit CSG.

At this time, two data driving units DDU closely located on both sides of the driving control unit DCU immediately receive the source output enable signal SOE from the control signal generation unit CSG, and the remaining data driving units DDU receive a source output enable signal SOE sequentially delayed by the signal delay/buffer units SDU. Accordingly, the closer to the driving control unit DCU the data driving unit DDU is located, the earlier the source output enable signal SOE is received. Therefore, the closer to the driving control unit DCU the data driving unit DDU is located, the earlier the sampled image data ID is output.

In addition, the digital/analog converter DAC converts the m/n pieces of sampled image data ID from the latch LT into an analog signal, and the signal buffer BF buffers the sampled image data ID from the digital/analog converter DAC and outputs the buffered image data.

Figure 8:
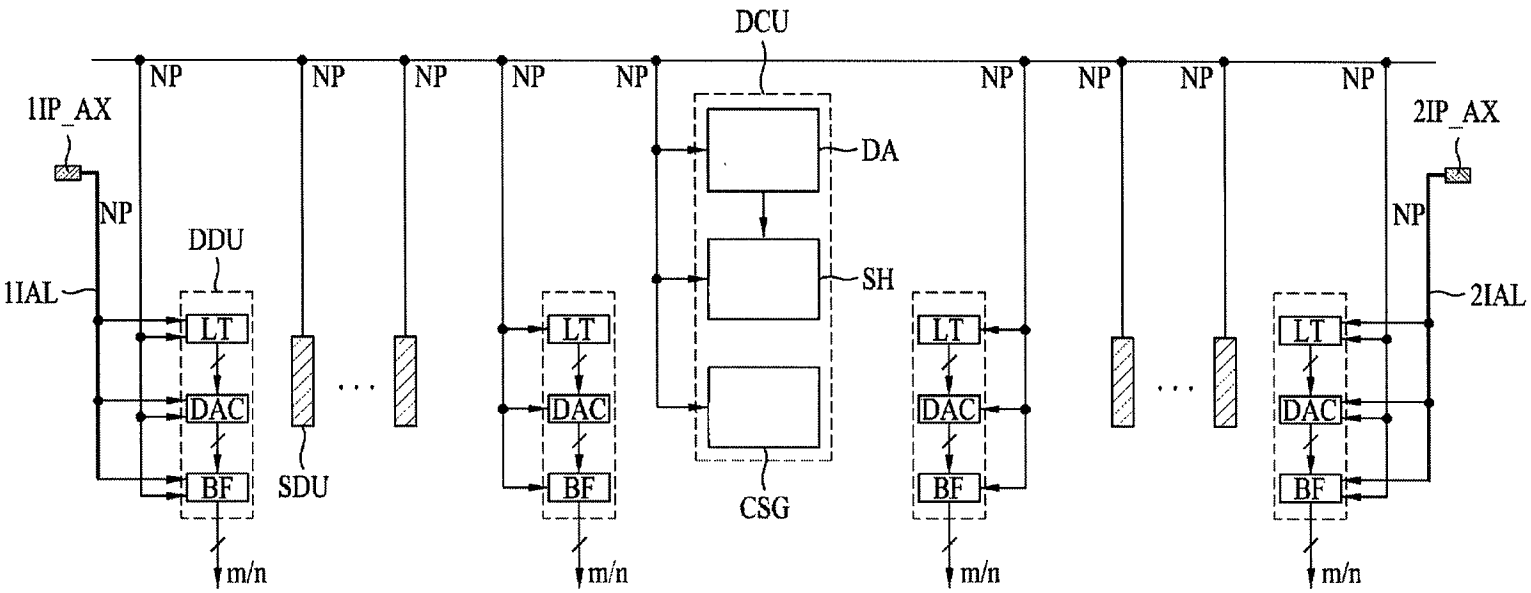
FIG. 8 is a diagram illustrating a process of supplying logic power to the driving control unit, the data driving units and the signal delay/buffer units according to an embodiment of the present invention.

Next, FIG. 8 is a diagram explaining a process of supplying logic power to the driving control unit DCU, the data driving units DDUs and the signal delay/buffer units SDUs. As shown, the logic power NP from the logic power transmission line 405 is supplied to the data alignment unit DA, the sample/hold unit SH and the control signal generation unit CSG in the driving control unit DCU and is also supplied to the latch LT, the digital/analog converter DAC and the signal buffer BF of each of the data driving units DDUs.

In particular, the latch LT, the digital/analog converter DAC and the signal buffer BF of the data driving unit DDU, which is farthest from the driving control unit DCU, among the data driving units DDUs located on the left side of the driving control unit DCU additionally receive the logic power NP transmitted through the first external auxiliary transmission line 10AL, the first auxiliary input pin 1IP_AX and the first internal auxiliary transmission line 1IAL. In addition, the latch LT, the digital/analog converter DAC and the signal buffer BF of the data driving unit DDU, which is farthest from the driving control unit DCU, among the data driving units DDUs located on the right side of the driving control unit DCU additionally receive the logic power NP transmitted through the second external auxiliary transmission line 20AL, the second auxiliary input pin 2IP_AX and the second internal auxiliary transmission line 2IAL. Further, the logic power NP is used when the data alignment unit DA, the sample/hold unit SH, the control signal generation unit CSG, the latch LT, the digital/analog converter DAC and the signal buffer BF perform the above respective functions.

Therefore, according to embodiments of the present invention, the logic power supplied to a data driving unit farthest from an input pin for supplying the logic power among the data driving units is not significantly distorted as compared with the remaining data driving units. Accordingly, image data output from the data driving units located on edges of the driving integrated circuit is also not distorted. That is, at edges of a screen, to which a distorted image data is supplied when the outside data driving units are not supplied with power as in the present invention, an image is conspicuous as compared with the other portion of the screen such that a block dim phenomenon where the screen seems to be divided and a screen noise phenomenon occur. That is, a block dim phenomenon and a screen noise phenomenon occur in the related art and thus image quality is deteriorated.

However, the driving circuit for the display device according to an embodiment of the present invention reduces distortion of logic power finally supplied to data driving units located on both edges of a driving integrated circuit by additionally supplying logic power transmitted through external auxiliary transmission lines, auxiliary input pins and internal auxiliary transmission lines to the two data driving units located on both edges of the driving integrated circuit. Accordingly, it is possible to prevent image quality from deteriorating due to a block dim phenomenon and a screen noise phenomenon.

Thus, in summary, the logic power transmission line 405 is used to supply power (e.g., +5 volts, +3 volts, etc.) to the data driving units (DDU). The data driving units (DDUs) are then driven and operate based on the received power. However, the DDUs at the outside or farther position from the DCU receive less power or a reduced amount of power because of the degradation in power as the power is attempting to reach the DDUs at the outside or farther position from the DCU. The present invention solves this problem by supplying additional power to the DDUs at the outside or farther position from the DCU.

In addition, FIGS. 4 and 6 illustrate the first external auxiliary transmission line 10AL, the first auxiliary input pin 1IP_AX and the first internal auxiliary transmission line 1IAL directly connected to the DDU at the outermost edge. However, the first external auxiliary transmission line 10AL, the first auxiliary input pin 1IP_AX and the first internal auxiliary transmission line HAL could be connected to two or more DDUs (i.e., be commonly connected to two or more DDUs. Thus, the embodiment in FIG. 6 would be modified so that the first external auxiliary transmission line 10AL, the first auxiliary input pin 1IP_AX and the first internal auxiliary transmission line HAL are commonly connected to the two outermost DDUs (and thus the third external auxiliary transmission line 30AL, the third auxiliary input pin 3IP_AX and the third internal auxiliary transmission line 3IAL could be eliminated). A similar concept applies to the right side DDUs.

In addition, in FIG. 6, the first external auxiliary transmission line 10AL, the first auxiliary input pin 1IP_AX and the first internal auxiliary transmission line 1IAL could be use to commonly connect two or more outside DDUs, and the third external auxiliary transmission line 30AL, the third auxiliary input pin 3IP_AX and the third internal auxiliary transmission line 3IAL could be connected to another DDU adjacent to the two outermost DDUs.

In still another embodiment, the DDUs may be grouped together for a particular auxiliary transmission line, auxiliary input pin and internal auxiliary transmission line. For example, three outermost DDUs may be set to be in a group of DDUs controlled by the first external auxiliary transmission line 10AL, the first auxiliary input pin 1IP_AX and the first internal auxiliary transmission line HAL. A second set of DDUs may be controlled by the third external auxiliary transmission line 30AL, the third auxiliary input pin 3IP_AX and the third internal auxiliary transmission line 3IAL. Thus, the DDUs can be grouped together in a variety of combinations so as to properly control the display of image data.

In still another embodiment, the present invention provides a graphical user interface (GUI) that a technician or user at home can use to adjust a number of DDUs being controlled. For example, the technician or user can see that the image is distorted at outer portions of the display when watching a particular movie, for example. Thus, one embodiment of the present invention allows the user to change the number of DDUs being supplied with additional power. For example, the GUI can include options "1. Decrease block dim phenomena at outside edges." If the user selects the option, the number of controlled DDUs would continually be increased. Switches could also be provided on the internal auxiliary transmission lines, for example, so that the number of controlled DDUs can be changed via the GUI. Thus, a user can actually variably changed the number of DDUs controlled (e.g., provided with additional power). In addition, because the general user may not be familiar with DDUs, the GUI can use option such as discussed above that the user can easily understand. For example, the user may notice distortion on the edges of the display and use the GUI to fix the distortion (i.e., increase or decrease the number of outside DDUs being controlled).

The present invention encompasses various modifications to each of the examples and embodiments discussed herein. According to the invention, one or more features described above in one embodiment or example can be equally applied to another embodiment or example described above. The features of one or more embodiments or examples described above can be combined into each of the embodiments or examples described above. Any full or partial combination of one or more embodiment or examples of the invention is also part of the invention.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A data driving circuit for a display panel, the data driving circuit comprising:

a driving integrated circuit including a plurality of data driving units n, where n is an even number greater than or equal to six, configured to supply image data to data lines of the display panel; and a package body including:

a mount region in which the driving integrated circuit is mounted, a plurality of logic power input patterns configured to transmit logic power to the plurality of data driving units, the plurality of data driving units divided into two halves such that n/2 of the plurality of data driving units are arranged on each side of the plurality of logic power input patterns, and at least two external auxiliary transmission lines formed in the mount region and connected to at least one logic power input pattern, said at least two external auxiliary transmission lines configured to selectively transmit a power received from the at least one connected logic power input pattern only to the plurality of data driving units located on both edges of the driving integrated circuit farthest from said at least one logic power input pattern, wherein only the plurality of data driving units located on both edges of the driving integrated circuit farthest from the at least one logic power input pattern are configured to receive the logic power via the at least one logic power input pattern in addition to the power selectively-transmitted via the at least two external auxiliary transmission lines.

2. The data driving circuit of claim 1, wherein the driving integrated circuit further includes:

logic power input pins connected to the logic power input patterns and configured to transmit the logic power to the plurality of data driving units;

input pins configured to receive control signals and the image data from a circuit board; and output pins configured to drive the display panel based on the received control signals and the image data.

3. The data driving circuit of claim 2, wherein the package body further comprises:

a plurality of input patterns for connecting the input pins of the driving integrated circuit to the circuit board supplying the image data and control signals to the driving integrated circuit; and a plurality of output patterns for connecting the output pins of the driving integrated circuit to the panel.

4. The data driving circuit of claim 1, wherein the driving integrated circuit further includes a power transmission line configured to supply power to all of the data driving units, wherein said at least two external auxiliary transmission lines are configured to transmit additional power to the data driving units located farthest from said at least one logic power input pattern, and wherein the farthest-located data driving units are further configured to receive the logic power from the at least one logic power input pattern via at least one of the plurality of data driving units disposed between the farthest-located data driving units and to receive the selectively-transmitted power directly from the at least two external auxiliary transmission lines.

5. The data driving circuit of claim 4, wherein said at least two external auxiliary transmission lines are configured to directly transmit power received from the at least one connected logic power input pattern to the data driving units located farthest from said at least one logic power input pattern.

6. The data driving circuit of claim 4, wherein said at least two external auxiliary transmission lines are configured to commonly transmit power received from the at least one connected logic power input pattern to at least two data driving units located farthest from said at least one logic power input pattern.

7. The data driving circuit of claim 4, wherein said at least two external auxiliary transmission lines includes at least four external auxiliary transmission lines configured to individually and directly transmit power received from the at least one connected logic power input pattern to at least four data driving units located farthest from said at least one logic power input pattern, respectively.

8. The data driving circuit of claim 4, wherein the driving integrated circuit further includes a driving control unit configured to generate a source output enable signal for determining output timings of the image data from the data driving units, and wherein the driving control unit is disposed between first and second sets of data driving units, and the data driving units are disposed spaced apart from one another in a direction away from the driving control unit.

9. The data driving circuit of claim 8, wherein said at least two external auxiliary transmission lines are configured to respectively transmit power received from the at least one connected logic power input pattern to at least two data driving units located in each of the first and second sets of data driving units farthest from the driving control unit.

10. The data driving circuit of claim 4, further comprising:

a graphic user interface configured to allow a number of the data driving units to be supplied with the additional power to be changed or adjusted and/or to allow a voltage amount of the additional power supplied to the data driving units to be changed or adjusted.

11. A display device, comprising:

a display panel including a plurality of data and gate lines interesting each other; and a data driving circuit for driving the display panel and including a driving integrated circuit including a plurality of data driving units n, wherein n is an even number greater than or equal to six, configured to supply image data to data lines of the display panel; and a package body, said package body including a mount region in which the driving integrated circuit is mounted, a plurality of logic power input patterns configured to transmit logic power to the plurality of data driving units, the plurality of data driving units divided into two halves such that n/2 of the plurality of data driving units are arranged on each side of the plurality of logic power input patterns, and at least two external auxiliary transmission lines formed in the mount region and connected to at least one logic power input pattern, wherein said at least two external auxiliary transmission lines are configured to selectively transmit a power received from the at least one connected logic power input pattern only to the plurality of data driving units located on both edges of the driving integrated circuit farthest from said at least one logic power input pattern, and wherein only the plurality of data driving units located on both edges of the driving integrated circuit farthest from the at least one logic power input pattern are configured to receive the logic power via the at least one logic power input pattern in addition to the power selectively-transmitted via the at least two external auxiliary transmission lines.

12. The display device of claim 11, wherein the driving integrated circuit further includes:

logic power input pins connected to the logic power input patterns and configured to transmit the logic power to the plurality of data driving units;

input pins configured to receive control signals and the image data from a circuit board; and output pins configured to drive the display panel based on the received control signals and the image data.

13. The display device of claim 12, wherein the package body further comprises:

a plurality of input patterns for connecting the input pins of the driving integrated circuit to the circuit board supplying the image data and control signals to the driving integrated circuit; and a plurality of output patterns for connecting the output pins of the driving integrated circuit to the panel.

14. The display device of claim 11, wherein the driving integrated circuit further includes a power transmission line configured to supply power to all of the data driving units, wherein said at least two external auxiliary transmission lines are configured to transmit additional power to the data driving units located farthest from said at least one logic power input pattern, and wherein the farthest-located data driving units are further configured to receive the logic power from the at least one logic power input pattern via at least one of the plurality of data driving units disposed between the farthest-located data driving units and to receive the selectively-transmitted power directly from the at least two external auxiliary transmission lines.

15. The display device of claim 14, wherein said at least two external auxiliary transmission lines are configured to directly transmit power received from the at least one connected logic power input pattern to the data driving units located farthest from said at least one logic power input pattern.

16. The display device of claim 14, wherein said at least two external auxiliary transmission lines are configured to commonly transmit power received from the at least one connected logic power input pattern to at least two data driving units located farthest from said at least one logic power input pattern.

17. The display device of claim 14, wherein said at least two external auxiliary transmission lines includes at least four external auxiliary transmission lines configured to individually and directly transmit power received from the at least one connected logic power input pattern to at least four data driving units located farthest from said at least one logic power input pattern, respectively.

18. The display device of claim 14, wherein the driving integrated circuit further includes a driving control unit configured to generate a source output enable signal for determining output timings of the image data from the data driving units, and wherein the driving control unit is disposed between first and second sets of data driving units, and the data driving units are disposed spaced apart from one another in a direction away from the driving control unit.

19. The display device of claim 18, wherein said at least two external auxiliary transmission lines are configured to respectively transmit power received from the at least one connected logic power input pattern to at least two data driving units located in each of the first and second sets of data driving units farthest from the driving control unit.

20. The display device of claim 14, further comprising:

a graphic user interface configured to allow a number of the data driving units to be supplied with the additional power to be changed or adjusted and/or to allow a voltage amount of the additional power supplied to the data driving units to be changed or adjusted.

* * * * *